United States Patent [19]

Herr et al.

[11] 4,014,275

[45] Mar. 29, 1977

[54] SEWING MACHINE RE-PROGRAMMABLE MEMORY

[75] Inventors: John Addison Herr, Garwood; Wolfgang Jaffe, Roselle Park, both of N.J.

[73] Assignee: The Singer Company, New York, N.Y.

[22] Filed: Nov. 13, 1975

[21] Appl. No.: 631,776

[52] U.S. Cl. ..... 112/158 E; 340/174 HA

[51] Int. Cl.[2] ..... D05B 3/02

[58] Field of Search ..... 112/158 E, 121.11, 121.12; 340/174 HA, 174 VC, 174 SP, 174 PM; 360/112

[56] References Cited

UNITED STATES PATENTS

| | | | |
|---|---|---|---|
| 3,385,244 | 5/1968 | Ramsey et al. | 112/121.12 |
| 3,385,245 | 5/1968 | Ramsey et al. | 112/121.12 |
| 3,425,047 | 1/1969 | Riggs | 360/112 X |
| 3,654,882 | 4/1972 | Kamena | 112/121.11 |
| 3,668,670 | 6/1972 | Andersen | 340/174 HA X |
| 3,830,175 | 8/1974 | Levor | 112/121.12 |
| 3,855,956 | 12/1974 | Wurst | 112/158 E |

*Primary Examiner*—Werner H. Schroeder
*Assistant Examiner*—Peter Nerbun
*Attorney, Agent, or Firm*—Edward L. Bell; Robert E. Smith; Julian Falk

[57] ABSTRACT

A re-programmable memory is provided for storing information data which may be used for controlling the stitch position coordinates in the operation of a sewing machine. The memory is provided by a strata of locally magnetizable material of which the magnetization may be relatively easily induced or erased. Relatively movable with respect to the strata are coding magnets which in comparison with the strata are permanent, and by which coded data may be selectively induced on the strata in the form of local magnetized areas. The stored data may be extracted from the strata either by direct mechanical linkage responsive to the local magnetized areas on the strata or by electrical output signals generated by a Hall effect device or the like in response to the local magnetized areas on the strata.

11 Claims, 3 Drawing Figures

SEWING MACHINE RE-PROGRAMMABLE MEMORY

BACKGROUND OF THE INVENTION

A number of different types of memory means are known per se which might be usable for storing operator generated stitch pattern data. Both magnetic and punched tapes are known as well as various data processing equipment.

Both magnetic tapes and the various electronic data processing equipment storage means require elaborate power supply as a prerequisite to operation and, in fact, the known electronic memories require substantial continuity of power supply for memory preservation. Punched tapes, while they possess a permanence independent of power supply continuity, require elaborate and cumbersome mechanical punching apparatus for preparation and would not, therefore, provide convenient adaptation to a household type sewing machine.

SUMMARY OF THE INVENTION

This invention provides a re-programmable memory for storing stitch position coordinate pattern data usable in the operation of a sewing machine which may utilize but does not require an electrical power supply for operation. This object of the invention is attained by the provision of a strata of material which is easily magnetizable locally and in which the local magnetized areas may be readily erased. The strata is movable relatively to coding and erase magnets fabricated of much more permanently magnetized material so as selectively to clear or magnetize local areas of the strata to provide for storage of stitch pattern data having permanence without the necessity for continued electrical power supply.

This invention comprehends the provision of means for response to the stored data either in purely mechanical fashion which is adaptable to plain zigzag sewing machines heretofore utilizing purely mechanical zigzag and work feed controlling means, as well as the provision alternatively of means for generating electrical response to the stored data which is adaptable to existing sewing machines having electronic stitch pattern controls.

DESCRIPTION OF THE DRAWINGS

In the accompanying drawings of a preferred embodiment of this invention:

Referring to the drawings, FIG. 1 illustrates an adaptation of the present invention to a sewing machine of the type described in greater detail in the U.S. Pat. No. 3,872,808 of Mar. 25, 1975 which is incorporated herein by reference.

Figure 1:
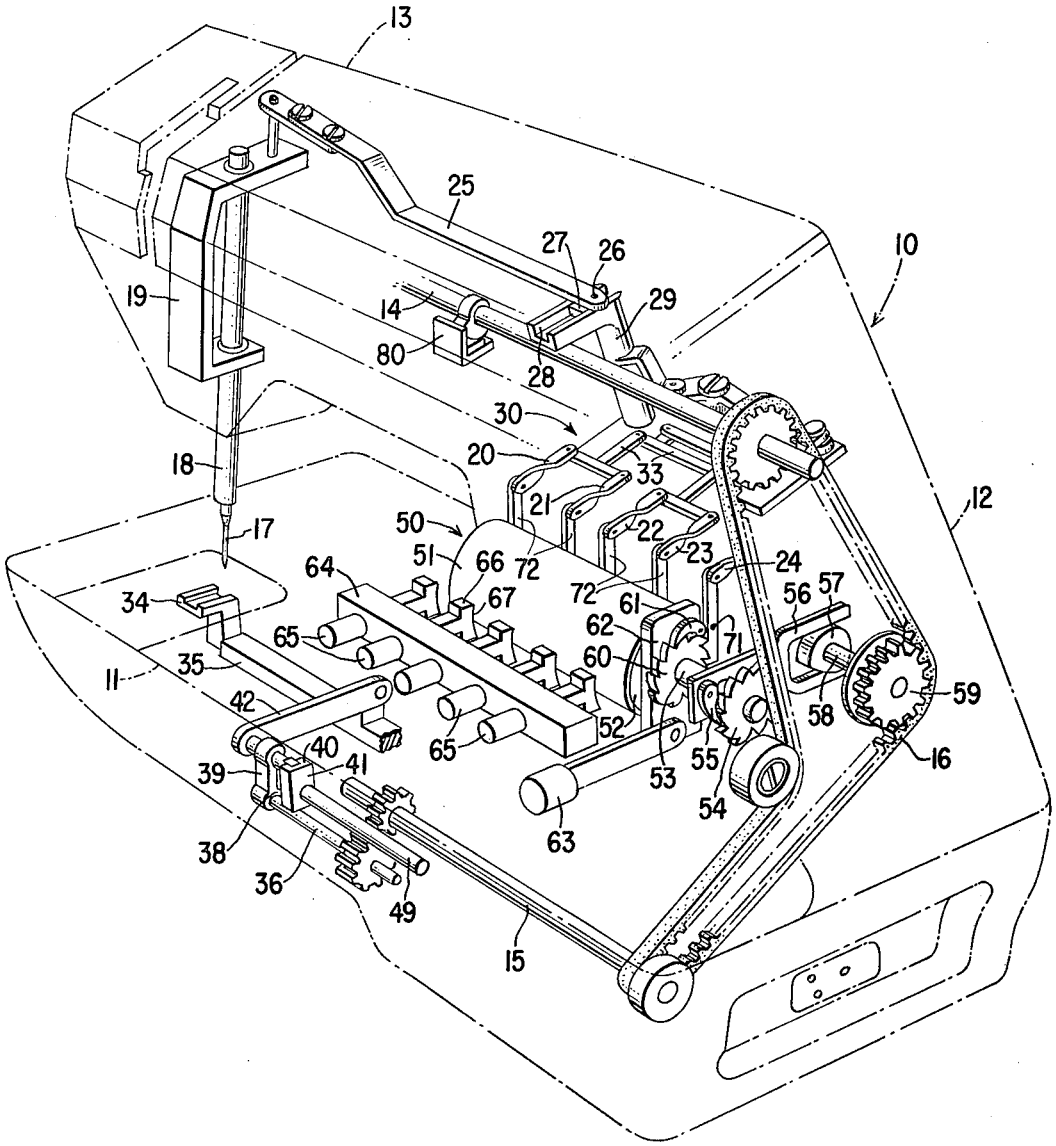
FIG. 1 represents a perspective view of a sewing machine with portions of the frame broken away to expose a programmable memory unit in accordance with this invention applied so as to respond in a mechanical fashion.

As shown in phantom lines in FIG. 1, a sewing machine casing 10 includes a bed 11, a standard 12 rising from the bed and a bracket arm 13 overhanging the bed. The driving mechanism of the sewing machine includes an arm shaft 14 and a bed shaft 15 interconnected by a timing belt 16 in the standard. A needle 17 is carried for endwise reciprocation by a needle bar 18 mounted for lateral jogging movement in a gate 19 in the bracket arm 13. Any conventional connections (not shown) may be used between the arm shaft 14 and the needle bar 18 for imparting needle reciprocation. A drive link 25 is pivoted as at 26 to a block 27 arranged in a lateral guide slot 28 of an oscillating driver 29 forming part of an actuator indicated generally at 30 for influencing lateral jogging of the needle or bight. The actuator 30 includes a whipple tree linkage 33 which is connected to the driver 29 and which includes five input arms 20, 21, 22, 23 and 24.

In the referenced U.S. Pat. No. 3,872,808, the whipple tree input arms are selectively positioned each by an individual solenoid indicated in the referenced patent by reference characters 20–24 respectively, whereas in the embodiment of the present invention illustrated in FIG. 1, the input arms 20–24 are influenced mechanically through magnets by the programmable memory unit of this invention as will be described in detail hereinbelow.

The input arms 20–24 each has a different significance to the output of the actuator 30 preferably in a binary code, i.e. arm 20 having the significance of one unit; arm 21, two; arm 22, four; arm 23, eight; arm 24, sixteen.

Also as illustrated in FIG. 1 is a portion of a work feeding mechanism including a feed dog 34 carried by a feed bar 35. In FIG. 1 the mechanism is illustrated for imparting work advancing movement to the feed dog including a feed drive shaft 36 driven by gears from the bed shaft, a cam 38 on the bed drive shaft 36, a pitman 39 embracing the cam 38 and connected to reciprocate a slide block 40 along a slotted feed regulating guide 41. A link 42 pivotally connects the pitman 39 with the feed bar 35 so that depending upon the inclination of the guide 41 the magnitude and direction of the feed direction and the feed dog will be determined, the inclination of the guide 41 may be influenced by manipulation of a rock shaft 49 which is secured to the guide.

In FIG. 1 only one actuator 30 is shown and that is connected so as to influence the needle jogging. It will be appreciated, however, that a similar actuator might be provided along with suitable connections linking the output to the rock shaft 49 so as to influence the position of the work feed controlling guide 41. In accordance with this invention an actuator similar to actuator 30 may be operatively connected to any instrumentality associated with the sewing machine which is capable of influencing the stitch position coordinates of successive needle penetrations during sewing machine operation.

Figure 2:
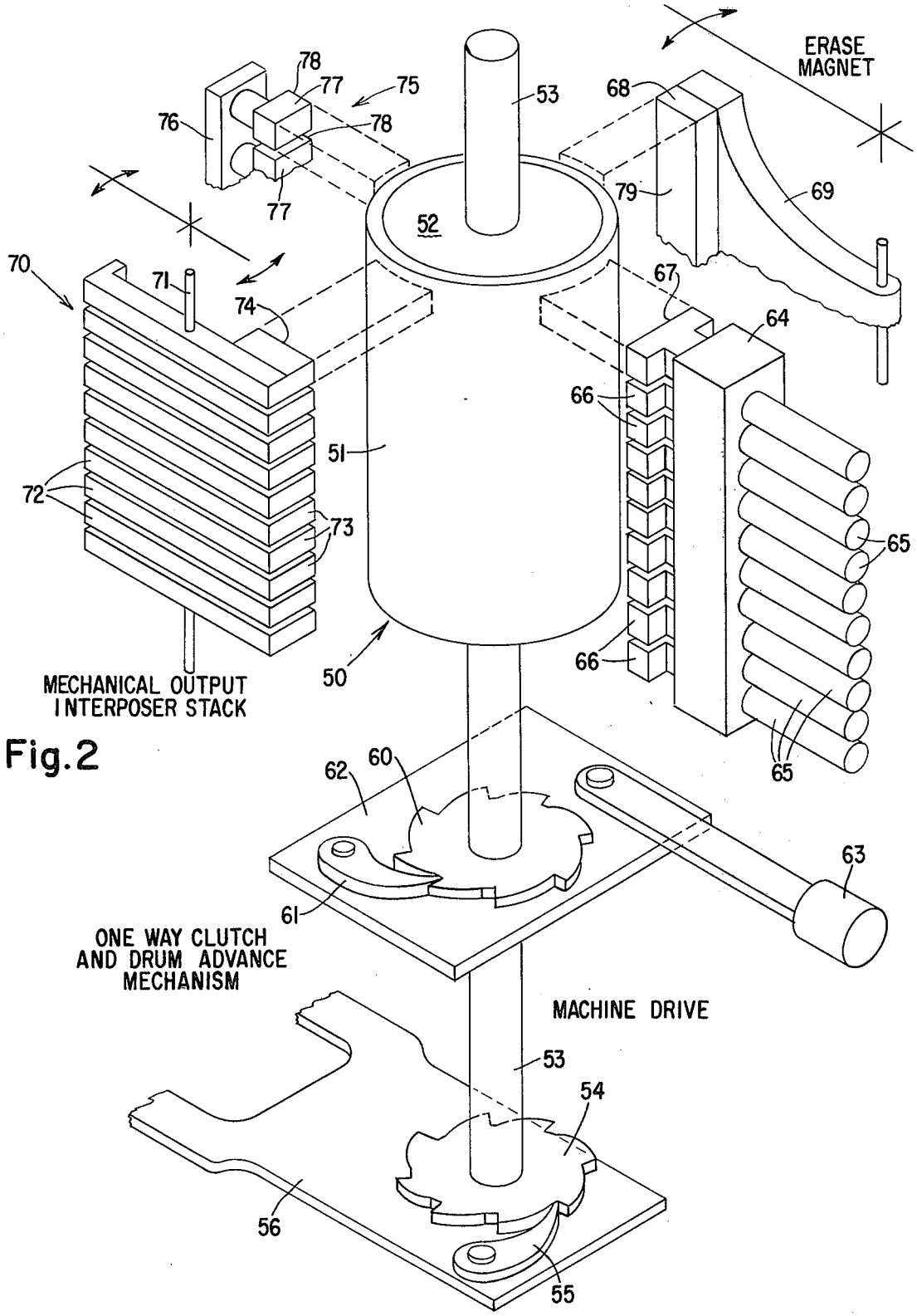
FIG. 2 is an enlarged exploded perspective view of the programmable memory unit of this invention.

A preferred form of the re-programmable memory unit 50 of this invention which is illustrated in FIGS. 1 and 2, will now be described. Preferably the programmable memory unit comprises a sleeve 51 of magnetizable rubber material which is carried as the outer layer or strata on a cylindrical steel drum 52 fast on a shaft 53 about the axis of which the stata 51 is rotatable.

Preferably, the sleeve of rubber magnetic material is adapted to be imparted angular increments of movement during operation of the sewing machine by means of a ratchet wheel 54 fast on the shaft 53 by the action of a pawl 55 which is pivotally mounted on a pawl operating arm 56 pivotally mounted on the shaft 53 and having an operative connection with a cam 57 on a stud shaft 58 in the sewing machine standard 12 to which a fixed pinion 59 is arranged to be driven by the timing belt 16.

A second ratchet 60 may be fixed to the shaft 53 for operation by a pawl 61 carried on an oscillating arm 62 which is adapted to be actuated by a manual plunger 63 so that the sleeve of magnetizable rubber may be rotated in step-by-step increments either by the operation of the sewing machine or as a result of repeated manual depression of the plunger 63.

Arranged alongside the sleeve 51 substantially parallel to the shaft 53 is a support block 64 carrying a plurality of spaced plungers 65 which are constrained in the support block to move substantially radially of the sleeve 51. At the extremity of each plunger 65 nearest the sleeve is secured a permanent magnet 66 preferably formed of rare earth material which is magnetized so as to provide a magnetic pole face 67 radially opposite a portion of the surface of the sleeve 51. Preferably each of the plungers 65 is spring biased radially away from the sleeve 51, but by depression of the respective plungers, the permanent magnets 66 may be shifted into that proximity to the strata of magnetizable rubber material of the sleeve 51 as to induce a localized magnetized area in the strata opposite and of the reverse polarity as the pole face 67 of the permanent magnet so shifted. Preferably, the increment of turning movement imparted to the sleeve 51 by each influence of either of the pawl and ratchet devices 54, 55 and 60, 61 will be sufficient to position a fresh area on the sleeve opposite the row of magnets 66. As shown in FIG. 2, 10 such rare earth magnets 66 with associated plungers 65 are provided so that five annular segments may be coded on the sleeve for providing pattern information for controlling the bight, i.e. the extent of lateral needle jogging movement; and five will be provided for providing the pattern information for regulating the sewing machine feed motion. Preferably the five coding magnets 66 devoted to the influence of each of these different stitch forming instrumentalities may be arranged to influence a different signal in a binary code capable of being summed, i.e. providing the signals, for instance, having a value to the base 10 of one unit; two units; four units; eight units and 16 units, respectively.

A single erase magnet 68 also preferably of rare earth magnetic material may be disposed radially alongside the sleeve 51 at a different location than the coding magnets 66 to erase selectively to change the polarity of any of the rows of localized magnetized areas previously imparted to the sleeve 51 by the row of coding magnets 66. The term "erasing" as used herein is meant to include the change of polarity. Any device for neutralizing the locally induced magnetism might also be used for erasing. As the sleeve 51 is shifted in angular increments, the selective depression of the plunger 65 at each incremental position of the sleeve, therefore, will impress upon the sleeve 51 selective magnetization in a given polarity of localized areas providing stitch position coordinate pattern data which may be used to control the sewing machine operation to produce patterns in accordance with the wishes of the sewing machine operator. Once the sleeve 51 has been locally magnetized in accordance with a desired pattern, that programmed pattern will remain stable on the sleeve until it is deliberately changed in polarity by the erasing magnet 68 which may be mounted upon a supporting frame 69 pivoted adjacent to the shaft 53 so that only when the erasing magnet is shifted into close proximity of the sleeve will the programmed pattern be erased from the drum.

A plurality of erase magnets 68 might also be provided having the same spacing and arrangement as the coding magnets so that the same selectivity in erasing might be provided as exists during coding. Individual bits of stored data might thus be erased and reprogrammed whether one single erase magnet or a plurality of erase magnets are employed, the pole face 79 of each such erase magnet which faces the sleeve 51 must be of the opposite polarity of the coding magnet pole faces 67.

The memory unit 50 disclosed herein, therefore, provides a random-access memory device, i.e. a device for storing stitch pattern data any or all of which may be at will erased and reprogrammed by an operator at the sewing machine.

FIG. 2 illustrates two alternative modes of extracting the stitch pattern data from the sleeve 51. The first form which will be described provides a purely mechanical output means 70 for extracting the pattern data. Mounted to turn on a pivot 71 substantially parallel to the shaft 53 are a series of mechanical output levers 72 corresponding in number and in spacing to the plungers 65 and coding magnets 66. At one end of each of the output levers 72 is secured a permanent magnet 73 with polarity at a pole face 74 opposite the sleeve 51 corresponding to the polarity of the respective coding magnets 66. As the sleeve 51 is rotated, each passage of a localized magnetized area of the same polarity as the coding magnet face 67 opposite any of the magnets 73 will cause a turning movement of the respective output lever which may be mechanically connected to control a stitch forming instrumentality of the sewing machine. As illustrated in FIG. 1, five such output levers 72 are shown each pivotally connected to one of the whippletree input arms 20–24, respectively, so that the stitch pattern data which the operator can store in the programmable memory unit 50 will be operated by the magnetism and mechanically applied to the sewing machine stitch forming mechanism. Preferably, the whippletree input arms are so arranged and limited as to range of motion that the presence of an unmagnetized area or of an area of the opposite polarity adjacent to the magnets 73 will not influence any usable motion in the levers 72.

Also illustrated in FIG. 2, an alternative electrical output means 75 is provided for extracting the stitch pattern data from the programmable memory unit 50. For this purpose, a support block 76 is arranged substantially parallel to the shaft 53 and mounted on the support block closely adjacent to the sleeve 51 are a plurality of sensing devices 77 each operatively connected to an electrical conductor 78 and responsive to the proximity of a magnetic field for generating a change to current flow in the sensing device. Preferably, the sensing devices 77 are arranged in the same spacing as are the coding magnets 66; each sensing device thus responding to the localized magnetized areas controlled by one of the coding magnets 66. Preferably, the sensing devices 77 may each comprise a Hall effect device which in response to a predetermined level of magnetic flux of a given polarity will generate a current in the conductor 78 associated therewith. The polarity for Hall effect switch operation is, of course, preferably chosen to correspond to that of the coding magnet faces 67. It will be understood that the sensing devices 77 might also comprise reed switches or the like for controlling the flow of current from an outside source through the conductors 78.

Reference is made to the Copending U.S. patent application Ser. No. 431,649 filed Jan. 8, 1974 which is incorporated herein by reference and discloses a sewing machine which includes a read-only-memory unit in which are permanently stored a plurality of predetermined stitch patterns which may be extracted from the read-only-memory and this extracted data utilized to control a bight regulator for the lateral jogging of the needle as well as a feed regulator for influencing the stitch length and direction between successive stitches. The electrical output means 75 of the re-programmable memory unit of this invention is adapted to be utilized to provide stitch pattern controlling signals which may be operated upon by the logic means and controlling instrumentalities of the above referenced U.S. patent application Ser. No. 431,649.

Figure 3:
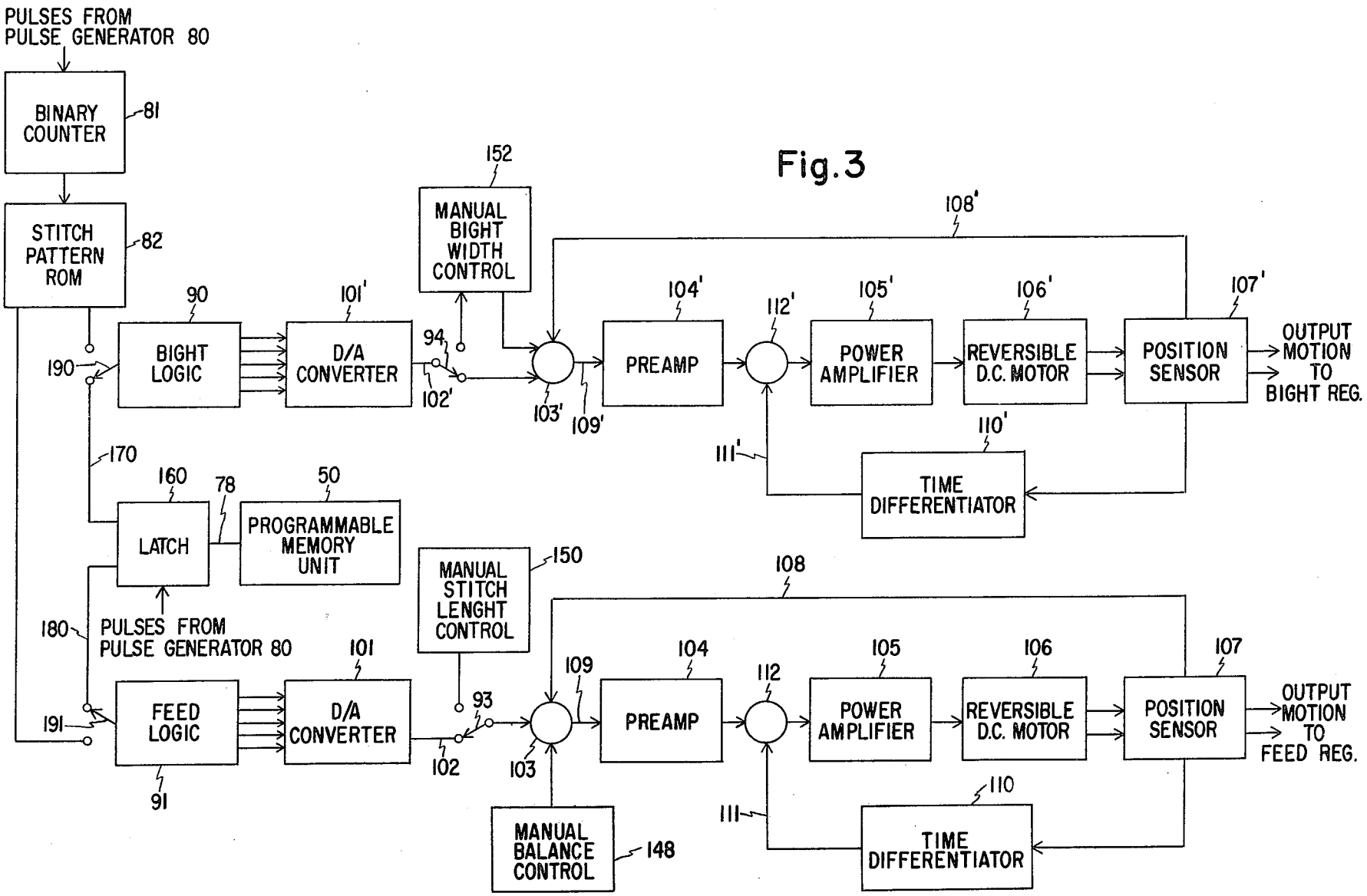
FIG. 3 is a general schematic block diagram of a system for adapting to an existing sewing machine having electronic stitch pattern controls, a programmable memory unit of this invention which generates electrical response to the stored data.

Referring to FIG. 3 it will be seen that the pulses from the pulse generator 80 are counted up in the binary counter 81 and presented as address inputs to the stitch pattern ROM 82 which is encoded to produce as output five bits of bight or zigzag information and five bits of feed information. The bight information is processed in logic block 90 and may include a latch whereby the bight information may be held for later release to the bight servo system at a time appropriate to the operation of the needle jogging mechanism. Similarly, the feed information is processed in logic block 91 and may include a latch whereby the feed information may be held for later release to the feed servo system at a time appropriate to the operation of the feed regulator. Since the servo systems for the bight and for the feed are identical except for the specific switching necessary for manual over-ride and balance control in the feed regulating system, the following description will for convenience, be confined to the feed servo system only and the specific switching for each system will be described later. Corresponding blocks in each system carry the same reference number except that the numbers associated with the bight or needle jogging system are primed.

The five bits of feed information from logic block 91 are presented to a digital-to-analog converter 101, which may be a commercially obtainable Motorola MC 1406 unit. The converter 101 outputs on line 102 a DC analog voltage representing the required feed position input. This line connects, in the automatic mode position of a switch 93, to the summing point 103 of a low level preamplifier 104 forming the first stage of a servo-amplifier system later to be described in detail. The switch 93 may comprise an F.E.T. switch. The preamplifier 104 drives power amplifier 105 which supplies direct current of reversible polarity to the electromechanical actuator 106, which in the broadest sense comprises a reversible motor, to position the actuator in accordance with the input analog voltage on line 102. A feedback position sensor 107 mechanically connected to the reversible motor 106 provides a feedback position signal on line 108 indicative of the existing output position. The input analog voltage and the feedback signal are algebraically summed at the summing point 103 to supply an error signal on line 109. The feedback signal from the position sensor is also differentiated with respect to time in a differentiator 110 and the resulting rate signal is presented on line 111 to the summing point 112 of the power amplifier 105 to modify the positional signal at that point. The position sensor 107 may be any device that generates an analog voltage proportional to position and may, in this embodiment, be a simple linear potentiometer connected to a stable reference voltage and functioning as a voltage divider. The differentiator 110 is preferably an operational amplifier connected to produce an output signal equal to the time rate of change of the input voltage as is well known in this art.

While the reversible motor 106 may be a conventional low-inertia rotory D.C. motor, it is preferable, for the purposes of the present invention that it take the form of a linear actuator in which a lightweight coil moves linearly in a constant flux field and is directly coupled to the load to be positioned. This simplifies the driving mechanical linkage and minimizes the load inertia of the system.

The switch 93 shown in the automatic mode position in FIG. 3 may be operated to the other or manual position. This disconnects the analog position voltage on line 102 from the summing point 103 and substitutes therefor a voltage obtained from a potentiometer 150.

Reverting now to the bight control channel of FIG. 3, a switch 94 shown in the automatic mode position may be operated to the other or manual position. The switch 94 may comprise a F.E.T. switch. This operation inserts a potentiometer 152 which acts as a scaling rheostat for the analog bight voltage on line 102' to provide any desired fraction of this voltage at the summing point 103' and so provides convenient means for narrowing the pattern.

As shown in FIG. 3, the output signals appearing on the conductors 78 from the programmable memory unit 50 may be directed to a latch 160 which is set by each pulse received from the pulse generator 80 and provides an output 170 to the bight logic 90 and an output 180 to the feed logic 91. An F.E.T. switch 190 may be used selectively to connect the bight logic 90 to the output of the programmable memory unit 50 or to the stitch pattern read-only-memory 82 of the sewing machine and an F.E.T. switch 191 may be used to selectively connect the output of the programmable memory unit or the stitch pattern ROM 82 to the feed logic 91. Preferably the switches 190 and 191 may be ganged for simultaneous shift from association with the ROM 82 to association with the re-programmable or random-access-memory unit 50.

As illustrated in FIG. 3, the re-programmable memory unit 50 of this invention is, therefore, compatible with the use of a stitch pattern read-out-memory unit 82 in a sewing machine in which the stitch position coordinate pattern data is electrically extracted and manipulated. The combination with a read-out-memory pattern data storage means of the re-programmable memory unit of this invention provides a convenient means whereby operator generated stitch patterns may be implemented while retaining in the machine the ability to select from permanently stored memory those patterns which are most frequently utilized.

Having set forth the nature of this invention, what is claimed herein is:

1. In a sewing machine operative to form successive stitches having stitch forming instrumentalities including an endwise reciprocating and laterally jogging needle means, and work feeding means for transporting work relative to said needle means, the relative positions of said needle means and said work feeding means defining stitch position coordinates for each endwise reciprocation of said needle means, at least one control device for influencing the stitch position coordinates of said successive stitches in the formation of a pattern of stitches, an electronic read-only-memory unit in said sewing machine for storing stitch pattern data, logic means electrically connected with said read-only-memory unit for extracting stitch position coordinate pattern data from said read-only-memory unit and actuating means for said control device responsive to said stitch pattern data extracted by said logic means, the improvement which comprises a re-programmable memory unit operatively associated with said sewing machine for storing operator generated stitch position coordinate pattern data, programming means accessible to an operator at said sewing machine for entering operator generated stitch position coordinate pattern data into said programmable memory unit, and operator influenced means for selectively electrically connecting said re-programmable unit to said logic means in place of said read-only-memory unit.

2. In a sewing machine as set forth in claim 1 further comprising memory influencing means in addition to said programming means accessible to an operator at said sewing machine for erasing stitch position coordinate data from said re-programmable memory unit whereby said memory unit may at will be reprogrammed by the operator.

3. In a sewing machine as set forth in claim 2 in which both the programming means for entering stitch position coordinate data and the memory influencing means for erasing stitch position coordinate data from said re-programmable memory unit are selectively effective while said re-programmable memory unit remains operatively associated with said sewing machine.

4. In a sewing machine having mechanism operative to form successive stitches, at least one control device for influencing the stitch position coordinates of said successive stitches in the formation of a pattern of stitches, an electronic random-access-memory unit associated with said sewing machine for storing stitch pattern data, logic means electrically connected with said random-access-memory unit for extracting stitch position coordinate pattern data from random-access-memory unit, actuating means for said control device responsive to said stitch pattern data extracted by said logic means, and programming means accessible to an operator of said sewing machine for entering operator generated stitch position coordinate pattern data into said random-access-memory unit.

5. In a sewing machine having stitch forming instrumentalities including an endwise reciprocating and laterally jogging needle, an actuating means operatively connected to influence lateral jogging movement of said needle into any selected one of a range or possible laterally jogged positions thereof, and logic means effective in response to electrical pattern data signals for operating said actuating means, the improvement which comprises a random-access-memory unit associated with said sewing machine, programming means accessible to an operator at said sewing machine for entering operator generated stitch position coordinated pattern data into said random-access-memory unit related to the lateral jogged positions of said needle which are necessary during a plurality of successive stitches to produce a selected pattern of stitches, means for extracting said stitch pattern data from said random-access-memory unit, means for generating electrical pattern data signals related to said stitch pattern data extracted from said random-access-memory unit, and means for applying said electrical pattern data signals to said logic means for operating the needle jogging actuating means.

6. In a sewing machine having stitch forming instrumentalities including an endwise reciprocating needle, and work feed mechanisn for transporting the work between successive needle penetrations, and actuating means operatively connected to influence the magnitude and direction of said work transport to regulate the stitch position coordinates of successive stitches, and logic means effective in response to electrical pattern data signals for operating said actuating means, the improvement which comprises a random-access-memory unit associated with said sewing machine, programming means accessible to an operator at said sewing machine for entering operator generated stitch position coordinate pattern data into said random-access-memory unit related to the magnitude and direction of work transport which are necessary during a plurality of successive stitches to produce a selected pattern of stitches, means for extracting said stitch pattern data from said random-access-memory unit, means for generating electrical pattern data signals related to said stitch pattern data extracted from said random-access-memory unit, and means for applying said electrical pattern data signals to said logic means for operating the work feeding means.

7. A programmable memory unit for storing operator generated stitch position coordinate pattern data for use in a sewing machine comprising, a strata of material capable of being selectively locally magnetized, at least one permanent coding magnet having a pole face arranged adjacent to and in spaced relation to a portion of said strata of material, means for shifting the position of said coding magnet and said strata of material relatively, means selectively effective in discrete positions of said coding magnet relatively to said strata for reducing the proximity of said coding magnet pole face to said strata sufficiently to induce a localized magnetized area in said strata opposite said coding magnet, and at least one sensing device arranged adjacent to and movable relative to said strata, and said sensing device being movable in response to said localized areas of said strata of material for producing a mechanical output by said sensing device.

8. A memory unit for storing operator generated stitch position coordinate data for use in a sewing machine as set forth in claim 7 in which said strata of material comprises a sheet of magnetizeable rubber and in which each permanent coding magnet comprises a rare earth magnet.

9. A memory unit for storing operator generated stitch position coordinate data for use in a sewing machine as set forth in claim 7 further comprising a sewing machine in combination therewith and in which said sensing device comprises a linkage, a block of magnetic material carried by said linkage adjacent said strata of material, and means shiftably supporting said linkage on said sewing machine with capacity for movement of said block of magnetic material in a direction normal to said strata of material under the influence of each passing localized magnetized area.

10. A memory unit for storing operator generated stitch position coordinate data for use in a sewing machine as set forth in claim 8 in which said sensing device comprises a switching device operatively connected to an electrical conductor and responsive to the presence of a magnetic field for producing a change of current flow in said electrical conductor, means supporting said switching device on said sewing machine adjacent said strata of material in sufficient proximity as to produce a response to each passing localized magnetized area.

11. A memory unit for storing operator generated stitch position coordinate data for use in a sewing machine as set forth in claim 7 further including at least one erase magnet having a pole face arrayed adjacent to and in spaced relation to a portion of said strata of material, means for shifting the position of said erase magnet and said strata relatively, and means selectively effective in discrete positions of said erase magnet relatively to said strata for reducing the proximity of said erase magnet pole face to said strata sufficiently to erase a localized magnetized area in said stata opposite said erase magnet.

* * * * *